United States Patent [19]

Naka

[11] 4,079,812

[45] Mar. 21, 1978

[54] MOVABLE SHELTER FLOOR TYPE EMERGENCY ESCAPE

[76] Inventor: Hiromitsu Naka, No. 39, Oaza Shinmachi, Yashio, Saitama, Japan

[21] Appl. No.: 666,074

[22] Filed: Mar. 11, 1976

[30] Foreign Application Priority Data

| | | |
|---|---|---|
| Mar. 13, 1975 | Japan | 50-29539 |
| Jun. 28, 1975 | Japan | 50-79737 |
| Aug. 1, 1975 | Japan | 50-93211 |
| Oct. 21, 1975 | Japan | 50-125906 |

[51] Int. Cl.[2] ..... A62B 1/20; E06C 9/10

[52] U.S. Cl. ..... 182/48; 182/84; 182/100; 182/208

[58] Field of Search ..... 182/84, 77–78, 182/79, 48, 49, 95, 96, 100, 189, 208

[56] References Cited

U.S. PATENT DOCUMENTS

| | | | |
|---|---|---|---|
| 205,949 | 7/1878 | Diekmann | 182/40 |
| 227,324 | 5/1880 | Tucker | 182/40 |
| 1,128,212 | 2/1915 | Woolard | 182/95 |
| 1,950,996 | 3/1934 | Potter | 182/48 |
| 2,709,030 | 5/1955 | Vroman | 182/84 |
| 2,812,528 | 11/1957 | Odell | 182/1 |
| 2,888,182 | 5/1959 | Nixon | 182/95 |
| 2,907,401 | 10/1959 | Wagner | 182/78 |
| 2,965,193 | 12/1960 | Murphy | 182/100 |
| 3,621,383 | 11/1971 | Rush | 182/48 |
| 3,894,614 | 7/1975 | Naka | 182/78 |

*Primary Examiner*—Reinaldo P. Machado
*Attorney, Agent, or Firm*—Wenderoth, Lind & Ponack

[57] ABSTRACT

A movable shelter floor type emergency escape for a multi-story building installed on the wall of each of the stories, including a movable shelter floor at one end pivotally mounted on the wall at an opening therein so as to be received in the framework defining the opening to close the opening when it is not used, and so as to open the opening when it is to be used, escape means normally received in an escape exit and downwardly extensible toward the movable shelter floor on a lower story, and means to support the movable shelter floor in a horizontal manner relative to the wall of the building.

14 Claims, 38 Drawing Figures

MOVABLE SHELTER FLOOR TYPE EMERGENCY ESCAPE

This invention relates to a movable shelter floor type emergency escape provided on each of the storeys of a multistories building such as an office building or an apartment house and adapted to communicate one of the adjacent stories with the other by pivotally moving down a movable shelter floor and then downwardly extending an escape means received in the movable shelter floor toward the next lower story when the escape is to be used.

Hitherto, there has been used as an emergency escape system for a multi-story building an escape chute, a rope ladder, an escape rope or the like and this has been installed in a box at the point in a room adjacent to the window or emergency exit thereof. When it is to be employed, it must be taken out of a storage box and thrown down through the window or exit and persons on the ground must secure the lower end of the escape system by any suitable means. Thereafter, the evacuees can escape to the safer ground. Thus, the conventional escape system requires a relatively long time for its preparation for use and, in addition, is not able to give simultaneous and quick refuge to a number of evacuees.

Evacuating by a chute simply suspended from the room where an emergency such as fire occurs has been tried, but it tends to be limited with respect to the of height of the building where it can be employed and, therefore, it cannot be installed on a large multi-story building.

There has been used an emergency stairway such as a stationary ladder provided outside of the building. However, when such a stairway is provided, the exit door should be locked in order to prevent an intrusion of thieves, etc. and various articles tend to be placed adjacent to the exit door. Thus, when an emergency occurs, the door cannot be quickly opened, with the result that many casualities have occurred.

Such emergency stairway is known to be a relatively effective installation, except for its imperfect maintenance. However, the scale and installation position are determined relative to the surrounding buildings and the road condition rather than from the standpoint of the safety of the people in the building where it is installed, because it is normally installed in a manner in which it projects from the building wall. In addition, such a stairway for a multi-story building is a large-scale structure and, therefore, lacks a sense of beauty.

Every year, a large amount of damage and a number of casualities have occurred due to fire and managers of multi-story buildings which tend to have large scale damages must prepare the buildings for an emergency and handle the emergency if it should occur. Actually, the number of the multi-story buildings which have caught fire is appreciably less than the total number of the buildings at present and, therefore most of the buildings have not employed such stairways. In addition, such a stairway occupies a large space. Thus, the emergency stairway must be improved to make more effective use of the building space.

Furthermore, death due to fire in multi-story buildings is mostly caused by suffocation due to smoke or by poisoning due to noxious gases.

In order to avoid such incidents, an emergency escape has been proposed which is adapted to be normally contained in an opening of the building wall so as to constitute a part of the building wall and on emergency to be swung down so as to form a veranda permitting evacuation. However, there are many problems to be solved, in connection therewith such as operation for evacuation, operating performance and durability with respect to natural conditions.

It is an object of the present invention to provide a movable shelter floor type emergency escape system for a multi-story building adapted to contain a movable escape floor in an opening of the building wall without its protruding therefrom so as to constitute a part of the building wall when the escape is not employed whereby detraction from the appearance of the building is prevented and whereby the space required for the escape system is minimized so that effective use can be made of the building space and which is adapted to form an escaping place by pivotally swinging the respective movable shelter floors on the story and securing them by means of respective supports and to connect the upper of two adjacent stories with the other by downwardly extending escaping means received in each of the movable shelter floors so as to form an escaping passageway therebetween, when the escape is to be employed.

It is another object of the present invention to provide a movable shelter floor type emergency escape system adapted to handle many evacuees in a very short time by forming a slide type escaping passageway between the adjacent stories by providing a slide type extensible escaping means including a pair of support arms which each comprise a plurality of telescopically extensible tubes and a slide member provided between the arms and estensible together with the extension of the arms.

It is further object of the present invention to provide a movable shelter floor type emergency system adapted to form a slide type escaping passageway by providing a pair of support arms including a plurality of sets of two rods traversely and pivotally mounted on each other with one of the sets extensibly connected to the adjacent set and a slide member provided between the arms and extensible together with the extension of the arms.

It is further object of the present invention to provide a movable shelter floor type emergency escape system adapted to form a slide type escaping passageway by providing a slide type expansible escape means comprising a refractory inflatable member which collapses when not used, but which is downwardly expanded by filling it with compressed air.

It is further object of the present invention to provide a movable shelter floor type emergency escape system adapted to form a ladder type escaping passageway by providing extensible escape means which comprises a pair of telescopically engaged tubes and treads mounted on and between the tubes.

It is further object of the present invention to provide a movable shelter floor type emergency escape system adapted to form a ladder type escaping passageway by providing extensible escape means which comprises a pair of support arms in the form of lazytongs and steps mounted on and between the support arms.

It is further object of the present invention to provide a movable shelter floor type emergency system adapted to form a stairway type escaping passageway by providing extensible escape means which comprises a pair of support arms of telescopically engaged tubes and a number of stair members mounted between the support arms.

It is further object of the present invention to provide a movable shelter floor type emergency escape system adapted to lock a movable shelter floor in an opening in a building wall when not in disuse by means of lock means operatively associated with the lock means movable shelter floors on the other stories and to unlock them when in use.

It is further object of the present invention to provide a movable shelter floor type emergency escape system adapted to pivotally open a movable shelter floor and to hold it in a horizontal manner by means of an actuator in cooperation with its unlocking operation.

It is further object of the present invention to provide a movable shelter floor type emergency escape system adapted to control the speed of a pivotal movement of a movable shelter floor by braking it when it is opened, by means of a control responsive to an unlocking operation.

It is further object of the present invention to provide a movable shelter floor type emergency escape system adapted to secure the forward end of an expanded escaping means in an upper story of two adjacent stories by catch means provided on a movable shelter floor of the next lower story.

It is further object of the present invention to provide a movable shelter floor type emergency escape system adapted to safely remove the evacuees during an emergency while putting their feeling at rest, by providing a protecting fence on a movable shelter floor.

The above and other features of the present invention will be apparent from the following description of the embodiments of the present invention taken with reference to the accompanying drawings wherein.

Figure 33:
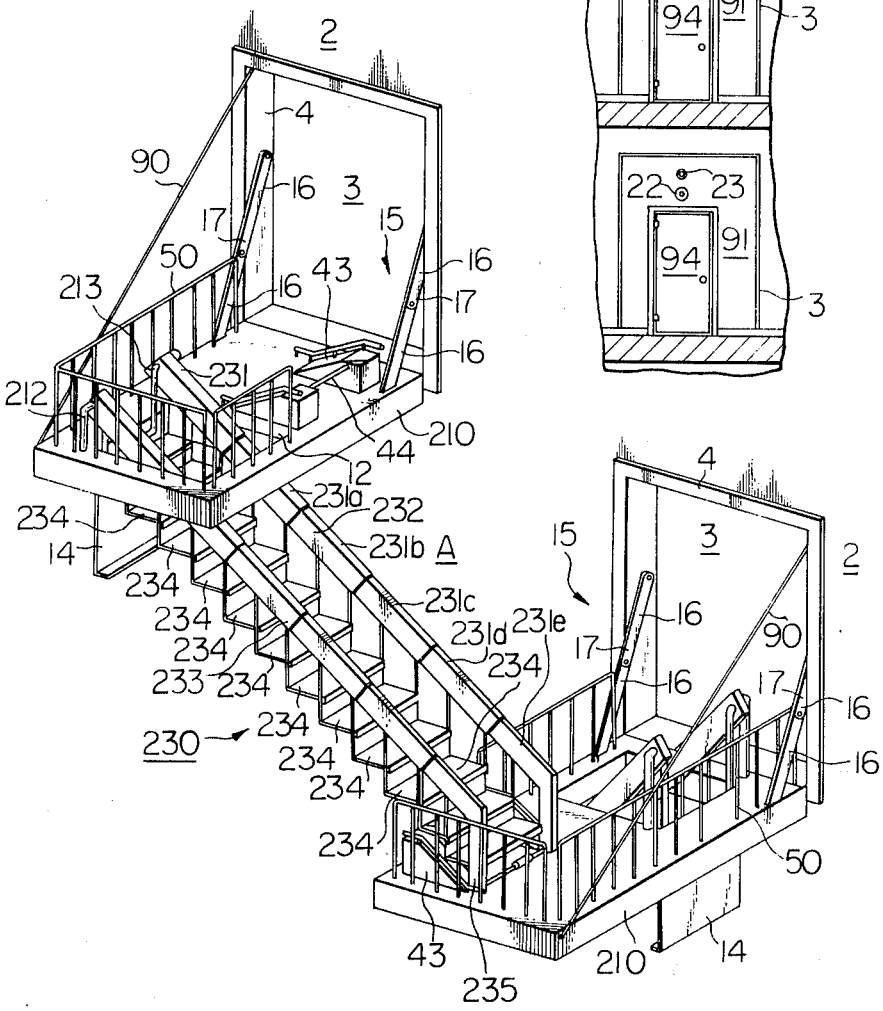
Figure 32:
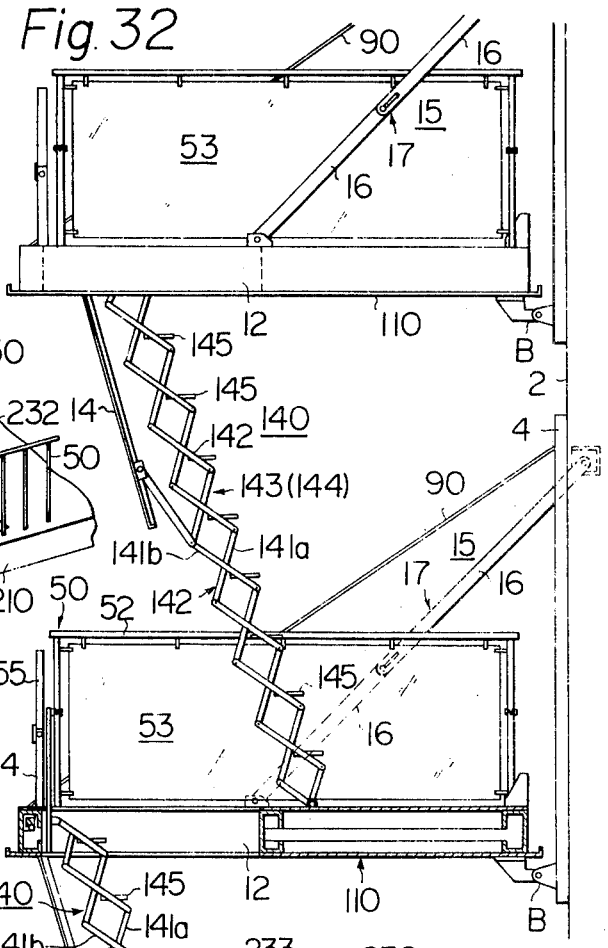
Figure 34:
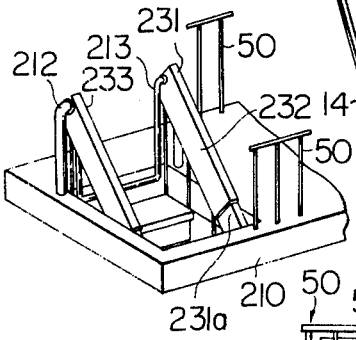
Figure 35:
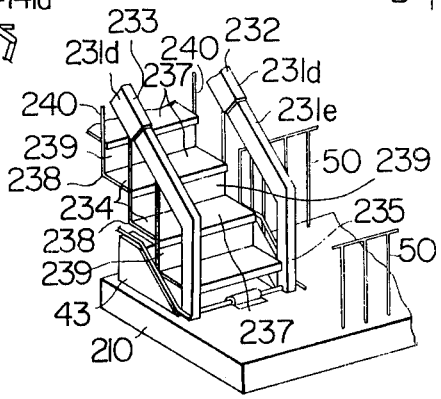
Figure 36:
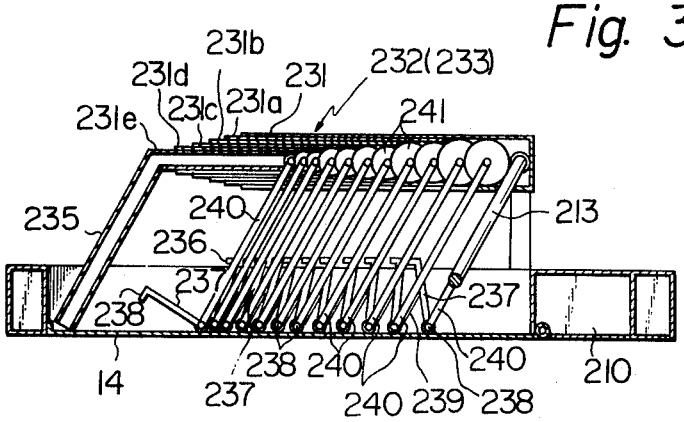
Figure 37:
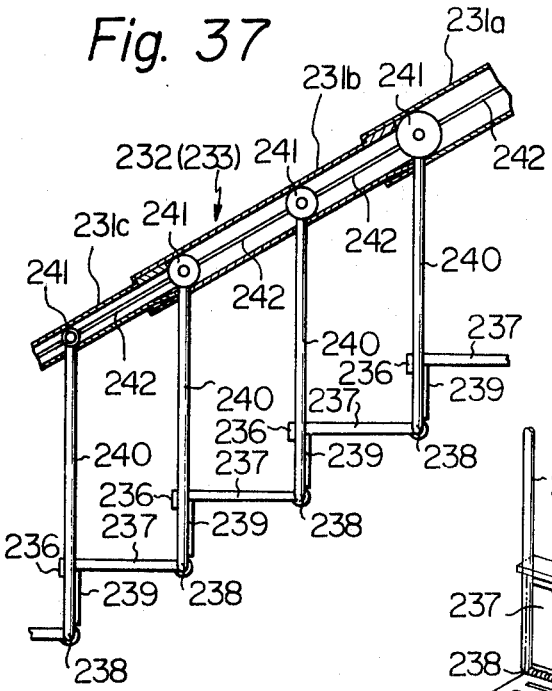
Figure 38:
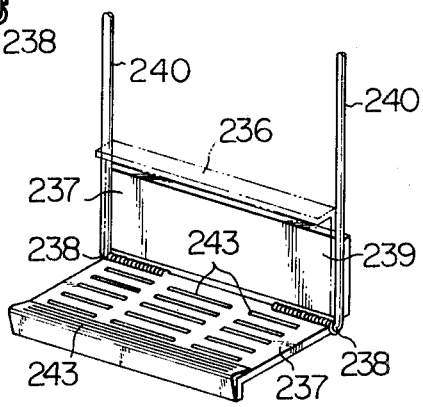

FIG. 32 in a side elevation view of a further modification of the escape means when it is in use;

FIG. 33 is a perspective view of another preferred embodiment when it is in use;

FIG. 34 is an enlarged perspective view of the movable shelter floor shown in FIG. 33;

FIG. 35 is an enlarged perspective view of the movable shelter floor on the next lower story shown in FIG. 33;

FIG. 36 is an enlarged sectional view of the stairway type extensible escape means shown in FIG. 33, when it is in a received or contained condition;

FIG. 37 is a fragmentary and enlarged sectional view of the expansible escape means of FIG. 36; and FIG. 38 is an enlarged perspective view of a rung in the escape means shown in FIG. 33.

Figure 1:
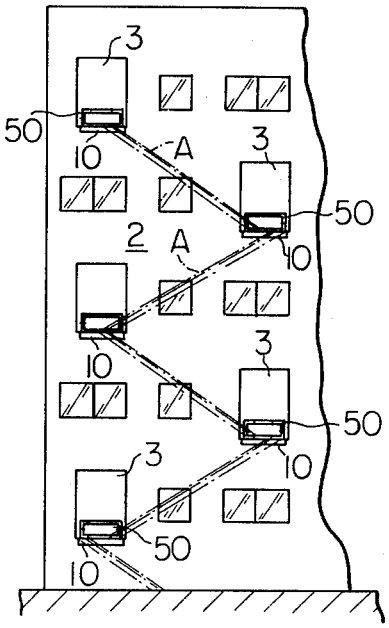
FIGS. 1 and 2 illustrate a building with an emergency escape system of the present invention installed thereon, FIG. 1 being a schematic elevational view thereof and FIG. 2 being an enlarged front elevational view thereof.
Figure 2:
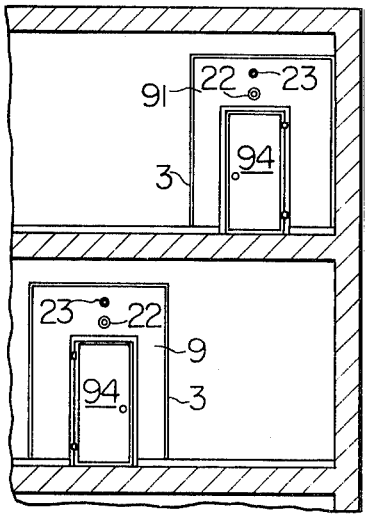
Figure 6:
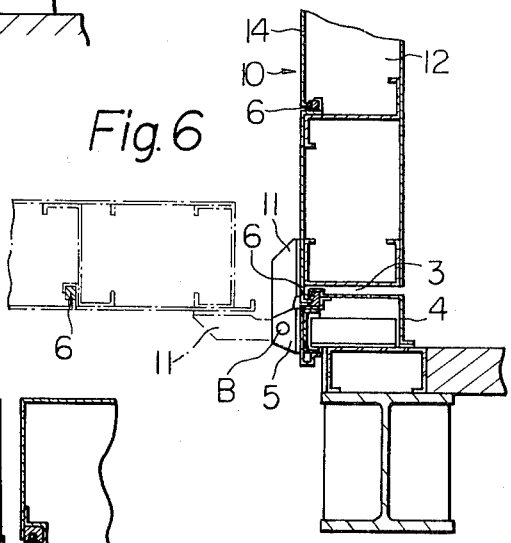
FIG. 6 is an enlarged cross sectional view of the movable shelter floor shown in FIGS. 3 and 4 when it is closed and showing it in the open position in chain lines.
Figure 3:
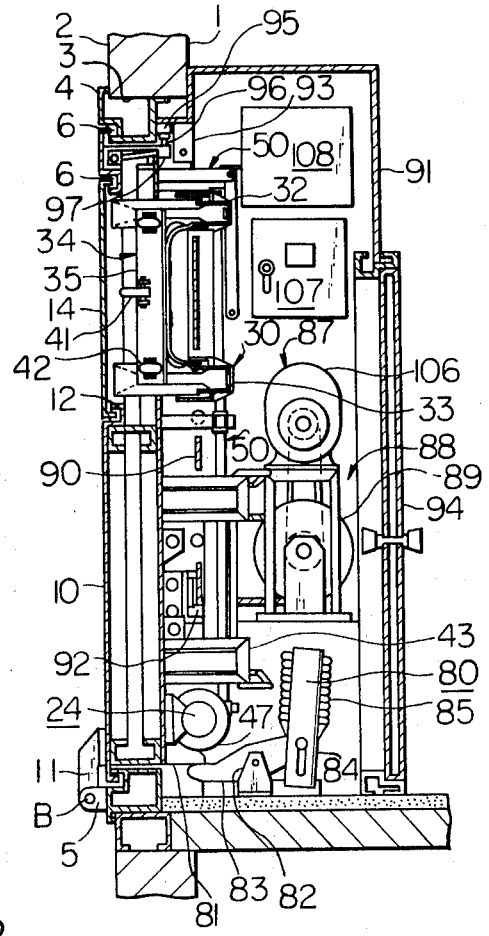
FIG. 3 is a vertical section of a part of the emergency escape system of FIGS. 1 and 2 when in disuse or in the closed position.
Figure 12:
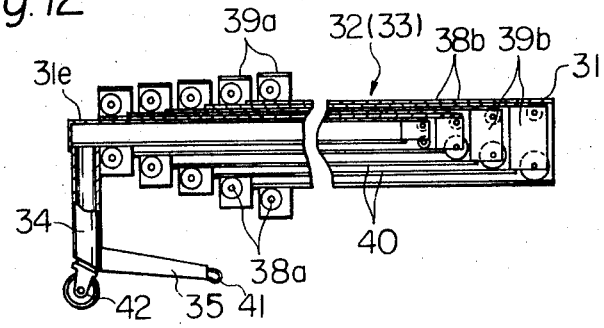
FIG. 12 is an enlarged sectional view of the slide type extensible escape means but omitting a sliding member.

Referring now to the drawings, and first to FIGS. 1–3 thereof, an embodiment of movable shelter floor type emergency escape system as constructed in accordance with the present invention comprises a slide type extensible escape means 30.

The slide type extensible escape means 30 is received or contained in a movable shelter floor 10 which is in turn provided on a building wall 1 in an opening 3 therein on each of the building stories. The escape means 30 is downwardly expanded toward the movable shelter floor 10 on the a lower story so as to form an escaping passageway A.

The opening 3 in each of the stories is provided with a framework 4 fitted thereinto. It will be noted that the openings 3 are preferably provided in an offset manner in adjacent stories as shown in FIGS. 1 and 2 when the movable shelter floor 10 has the slide type extensible escape means 30.

The movable shelter floor 10 which opens or closes the opening 3 comprises a rectangular frame and upper and lower panels secured to the frame and is connected to the framework 4 by pivotal pieces on the floor 10 pivotally mounted on stationary pieces on the framework 4 as is indicated at B in FIGS. 3 to 6. As apparent from FIG. 5, the movable shelter floor 10 sealingly closes the opening 3 by means of a gasket 6, when it is positioned within the framework 4 and is not in use.

Figures 4, 5:
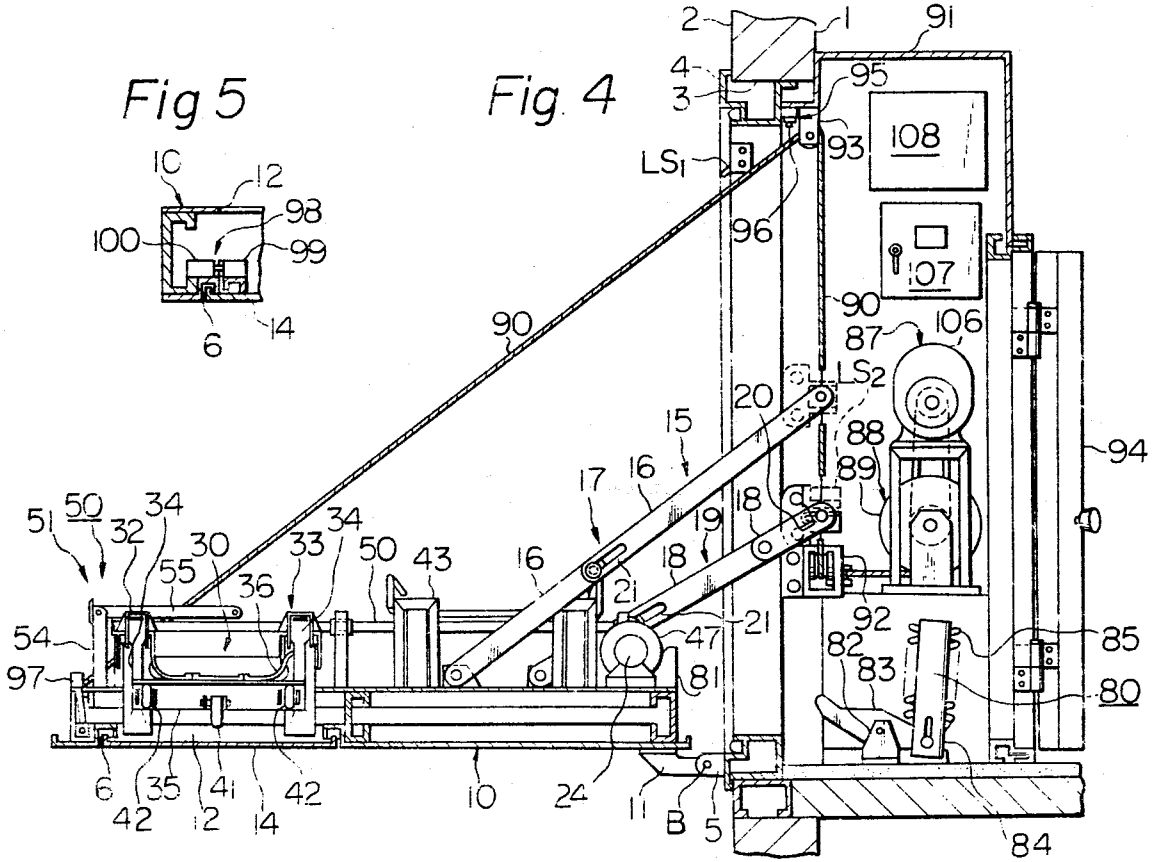
FIG. 4 is a view similar to FIG. 3, but shows the emergency escape in use and a movable shelter floor held in a horizontal position.
FIG. 5 is a fragmentary and enlarged sectional view of lock means for a cover of the movable shelter floor shown in FIG. 4.

Support means 15 is provided which holds the movable shelter floor 10 in a horizontal manner relative to the outside surface 2 of the building wall 1 as shown in FIG. 4, when it is in use. This support means 15 comprises a first linkage 17 including two elongate pivotal link members 16 and a second linkage 19 including two short pivotal link members 18 both of which are pivotally mounted on the framework 4 and the frame of the shelter floor 10. Respective pivotal connections of the first and second linkages 17 and 19 have respective slots 21 provided in one of the link members 16 and 18 to facilitate pivotal movement of the movable shelter floor 10 either when it is to be used or when it is to be contained. It will be appreciated that the support means 15 for the movable shelter floor 10 may comprise a hydraulic damper, spring means or the like in addition to the linkages.

Figure 7:
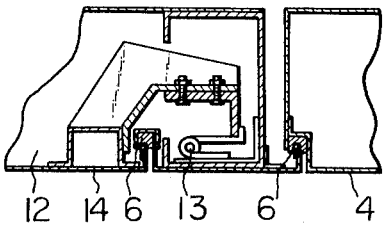
FIG. 7 is an enlarged cross sectional view of the cover for the movable shelter floor shown in FIG. 3 when it is closed.

As shown in FIG. 4, the movable shelter floor 10 has an escape exit 12 formed adjacent to the free edge thereof and closed by a cover 14 which is in turn pivotally mounted on the shelter floor 10 by a pivot shaft 13. As shown in FIG. 7, the cover 14, when closed, seals the escape exit 12 by means of a gasket 6.

Slide type extensible escape means 30 is mounted on the cover and as shown in FIGS. 10-14 comprises a pair of support arms which include six telescopically engaged tubes 31, 31*a*, 31*b*, 31*c*, 31*d* and 31*e*, with the leading one of the adjacent tubes being slidably received in the other tube, a U-shaped frame member 34 mounted on and between the leading ends of the support arms 32 and 33 which are the ends of the tubes 31*e* to form a lower exit having a seat 35 mounted thereon, and an extensible sliding member 36 of fabric or synthetic resin mounted on and between the support arms 32 and 33 to form a slide passageway together with the latter.

The telescopically engaged tubes 31, 31*a*, 31*b*, 31*c*, 31*d* and 31*e* of the support arms 32 and 33 each have wheels 38*a* and 38*b* mounted at the front and rear ends thereof, the front wheels 38*a* being supported by means of brackets 39*a* outside of the corresponding tubes and engaging the outer surfaces of the next leading tube, respectively, and the rear wheels 38*b* being supported by means of brackets 39*b* inside of the corresponding tubes and engaging the inner surfaces of the subsequent tube, respectively. Thus, slidable movement of the telescopically engaged tubes 31, 31*a*, 31*b*, 31*c*, 31*d* and 31*e* can be effected in a smooth manner when the support arms are to be extended or contracted.

The telescopically engaged tubes are each provided with a longitudinal slot which serves to guide the sliding member 36 at the suspending portion. The telescopically engaged tubes each have a stop (not shown) at the leading edge of the inside surface and at the rear end have a engaging portion (also not shown) and serving to engage the stop of the outside tube when they are fully expanded, so that the inside tubes are prevented from being drawn out of the outside tubes.

A pair of support arms 32 and 33 which comprise the telescopically engaged tubes 31, 31*a*, 31*b*, 31*c*, 31*d* and 31*e* are mounted on the cover 14 at an appropriate angle of inclination relative thereto. The cover 14, when opened, is carried by the movable shelter floor 10 adjacent to the escape exit 12 thereof by a suspending arm 37 which comprises a pair of link members pivotally connected to each other, so that the cover 14 holds the extended slide type escape means 30 at a predetermined angle of inclination relative to the movable shelter floor 10.

The slide type extensible escape means 30 is provided at the U-shaped frame member 34 with guide wheels 42 rolling on a catching base 43 on the movable shelter floor 10 of the lower story, and at the rear end of the seat 35 with a latching rod 41 which is latched to a catching member 44 on the catching base 43 of the floor 10 of the lower story. Of course, the movable shelter floor 10 on the upper story may have a catching base 43 serving to receive a slide type extensible escape means (not shown) on the movable shelter floor on a still higher story.

Figure 8:
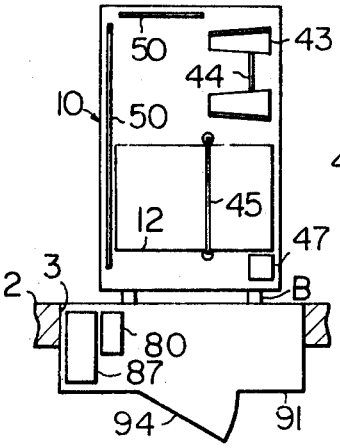
FIGS. 8 and 9 are schematic top views of the movable shelter floor when it is opened to the horizontal position.
Figure 9:
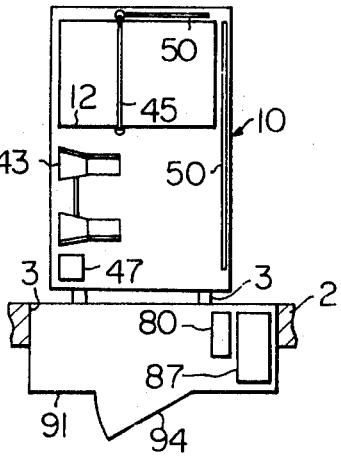

As seen from FIGS. 8 and 9, in one of the movable shelter floors 10 on the adjacent stories, the escape exit 12 is provided adjacent to the outer surface of the wall while the catching base 43 is provided on the end of the floor 10 remote from the outer surface of the wall 1, but in the other movable shelter floor 10, the escape exit 12 is provided remote from the wall surface while the catching base 43 is provided adjacent to the wall surface.

Figure 10:
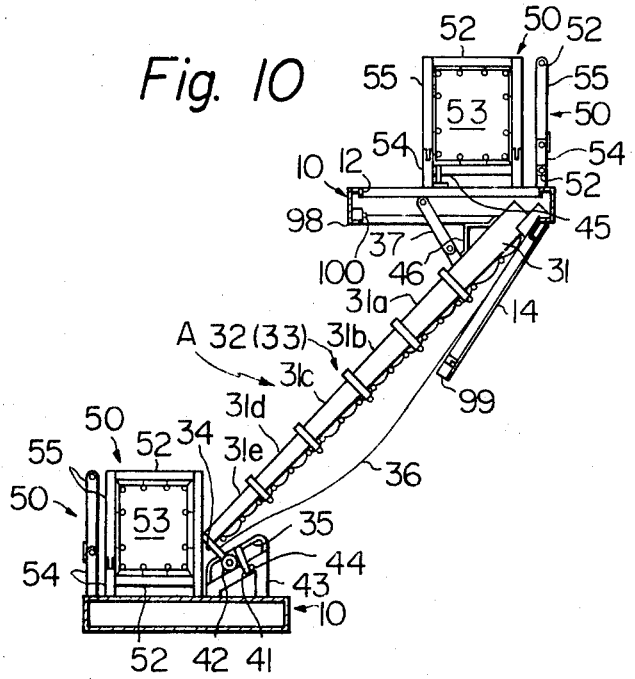
FIG. 10 is a front elevational view of a portion of the emergency escape system shown in FIG. 1 when it is in use.
Figure 11:
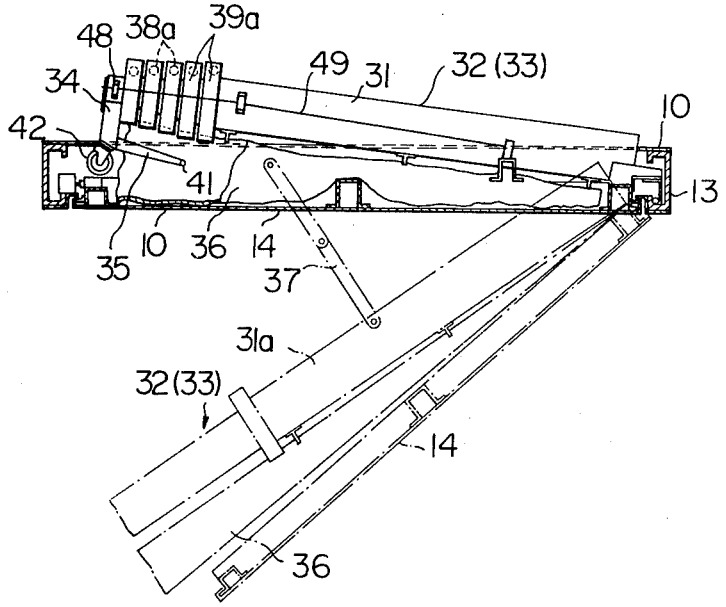
FIG. 11 is an enlarged sectional view of a slide type extensible escape means incorporated in the emergency escape system shown in FIGS. 1 and 2 when it is contained; in the cover
Figure 13:
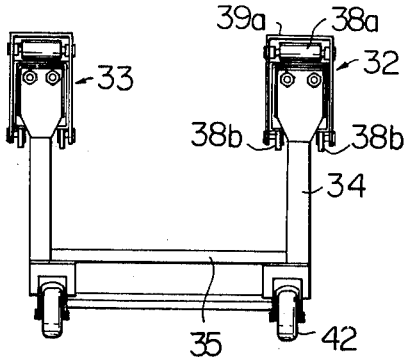
FIG. 13 is an enlarged front view of the extensible escape means also omitting the sliding member.
Figure 14:
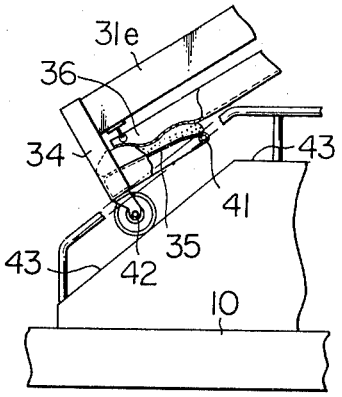
FIG. 14 is an enlarged side view of the lower end of the extensible slide type escape means associated with latch means provided on the movable shelter floor on a next lower story, with a portion broken away.
Figure 15:
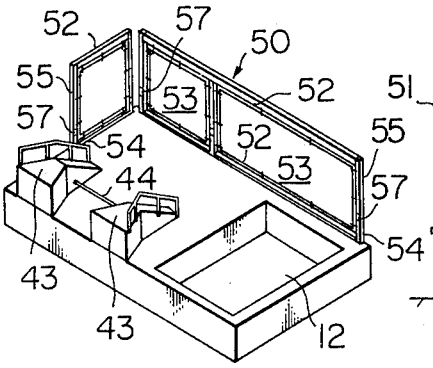
FIG. 15 is a perspective view of the movable shelter floor with the slide type extensible escape means removed therefrom.
Figure 16:
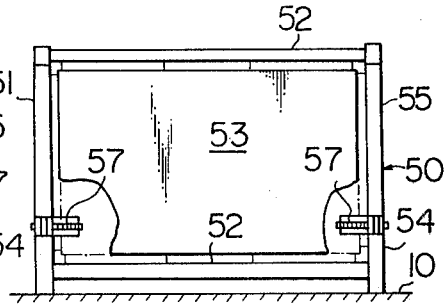
FIG. 16 is an elevational view of a protecting fence.

As shown in FIG. 10, a handrail 45 is provided adjacent to the escape exit 12 of the movable shelter floor 10 and a foot guard 46 is provided on the uppermost tubes 31 of the support arms 32 and 33 when they are expanded. A hoist 47 is provided on the movable shelter floor 10 adjacent to the pivotal connection to the wall 1. The hoist 47 has a wire rope 49 connected at one end to a reel not shown and at the other end through a pulley 48 to the uppermost tube 31 of one of the arms 33 as shown in FIG. 11, so as to contract the support arms 32 and 33 and receive them in the cover 14 when the hoist is operated. More particularly, the leading tubes 31*a*, 31*b*, 31*c*, 31*d* and 31*e* of the telescopical ones are slidably drawn into the rear ones 31, 31*a*, 31*b*, 31*c* and 31*d* so as to contract the extended support arms 32 and 33. The hoist can be a commercially available device.

The movable shelter floor 10 is also provided with a protecting fence 50 which comprises collapsible posts 51, upper and lower frames 52 mounted between the adjacent posts 51, and soft sheets 53 attached to the frames 52 by means of hooks not shown. The posts 51 each comprise a stationary portion 54 secured to the floor 10 and a movable portion 55 pivotally mounted on the stationary portion 54 at the top thereof.

Figure 17:
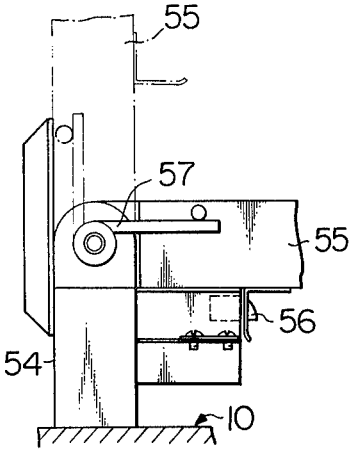
FIG. 17 is a partial view on an enlarged scale of lock means for the protecting fence.
Figure 18:
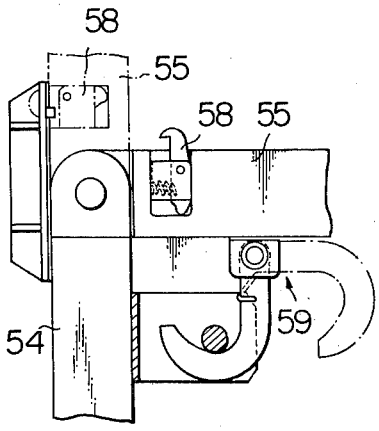
FIG. 18 is an enlarged side elevational view of mounting means and safety means for the protecting fence.

As shown in FIGS. 17 and 18, each of the posts 51 is provided with lock means 56 which serves to lock the movable portion 55 in the collapsed condition relative to the stationary portion 54, and also with latch means 58 which serves to latch the movable portion 55 to the stationary portion 54 after the former is raised. A return spring 57 is provided to automatically raise the movable portion 55 in an aligned manner when it is unlocked.

As shown in FIG. 18, a safety device 59 is provided which is in the form of hook and prevents jumping of the return spring 57 when the movable portion 55 is collapsed. The safety device may be in a non-operative position after the lock means 56 locks the movable portion 55.

Figure 19:
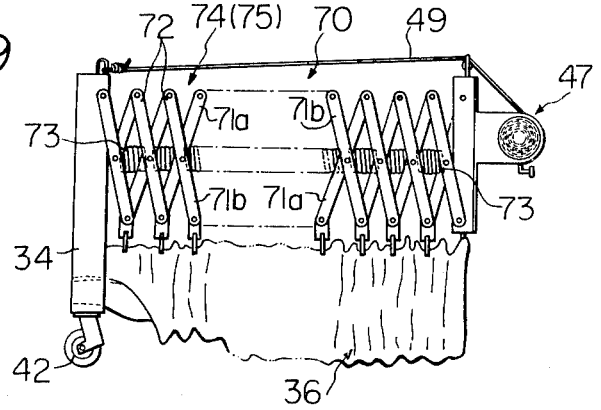
FIG. 19 is an enlarged side view of a modification of slide type extensible escape means.

FIG. 19 shows a modification of the slide type extensible escape means used in the present invention. The slide type extensible escape means 70 comprises a pair of support arms 74 and 75 in the form of lazy-tongs, a slide member 36 of extensible fabric or synthetic resin sheet suspended between the support arms 74 and 75 and cooperating with the support arms to form a slide type passageway, and a U-shaped frame member 34 mounted on the support arms 74 and 75 to form a lower exit. In the illustrated embodiment, the support arms 74 and 75 comprise a plurality of units 72 including two strip-like rods 71*a* and 71*b* pivotally connected to each other in a traverse manner, with one of the adjacent units 72 at the free end being pivotally mounted on the other unit at the free end and with a spring 73 being provided between the adjacent units so as to urge the support arms to be extended. In connection with this modification, the same numerals designate the same components as described with reference to the above described embodiment.

Figure 20:
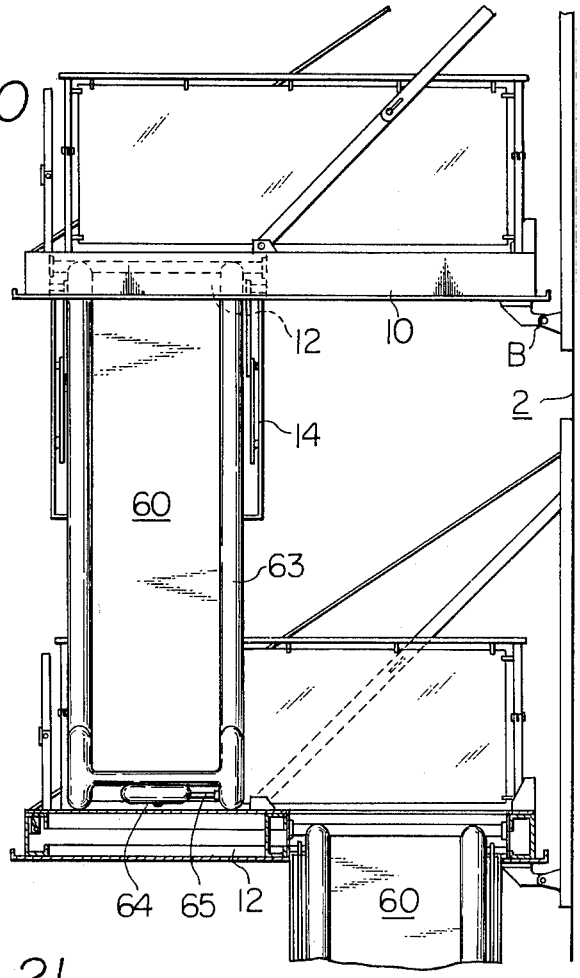
FIG. 20 illustrates a further modification of slide type extensible escape means when in use.
Figure 21:
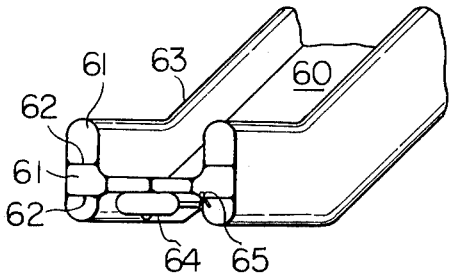
FIGS. 21 and 22 are fragmentary perspective views of the slide type extensible escape means shown in FIG. 20.
Figure 22:
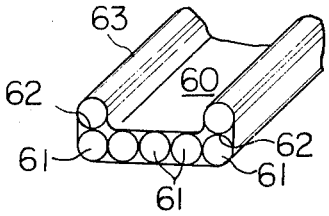

FIGS. 20 to 22 show another modification of slide type extensible escape means used in the present invention. The slide type escape means of this embodiment comprise a slide body 63 including an air inflatable member 61 composed of refractory fabric covered with a sealing layer and divided by partitions 62 into a number of chambers, a cylinder 64 containing a compressed inert gas such as liquefied carbon dioxide gas or the like, and an air supplying device 65 provided to communicate the cylinder with the inflatable member 61.

When the movable shelter floor 10 and then the cover 14 are opened so that the latter is inclined toward the lower story, the air supplying device 65 automatically supplies the compressed air into the inflatable member 61 so that the slide body is expanded to form an escape passageway having a cross section of U-shape or H-shape, as shown in FIGS. 21 and 22. The same numerals designate the same components as described in connection with the above described embodiments.

It will be appreciated that the slide body can comprise a number of inflatable elements arranged so that a predetermined shape of the slide is formed, and can be covered with a forming layer surrounding the inflatable elements.

Operating means is provided which serves to operate the emergency escape having any one of the slide type escape extendable means 30, 60 and 70, in a safe, positive and quick manner. The operating means comprises a lock means 95 operatively associated with those on the stories to lock the movable shelter floor 10 in the opening 3, an actuator 80 to pivotally move the movable shelter floor 10 so that it projects in a horizontal manner in response to an unlocking operation of the lock means 95, a brake 87 simultaneously operating with those on the other stories and operated in response to the unlocking operation of the lock means 95 to control the speed of pivotal movement of the shelter floor 10 by a braking system, and a floor position detector $LS_1$ $LS_2$ simultaneously operating with corresponding detectors $LS_1$ and $LS_2$ on the other stories and operated to signal the brake 87 to stop the operation when the movable shelter floor 10 reaches the horizontal position. The actuator 80 may be provided on the building floor.

As shown in FIGS. 3 and 4, the actuator 80 includes a raising arm 83 pivotally mounted on a floor stand 82 and having a free end engaging a tongue 81. on the floor 10 The raising arm 83 at the other end engages a loaded or pressure accumulating spring 85 which acts on the arm when the floor 10 is not in use.

The speed of pivotal movement of the movable shelter floor 10 is controlled while it is braked relative to the outer surface 2 of the wall 1 and the movable shelter floor 10 moves into the framework 4 so as to close the opening 3. The brake 87 comprises a hoist 88 and a wire rope 90 wound on a drum 89 of the hoist 88 with one end of the rope connected to the drum 89 and with the other end connected to the free end of the movable shelter floor 10. The wire rope 90 is guided by pulley means 92 and 93, which are mounted on and within a containing case 91.

The containing case 91 contains the movable shelter floor 10, the actuator 80 and the brake 87 in a position spaced from the story where the movable shelter floor 10 is installed. Access to the interior of the case 91 is through a door 94.

Figure 23:
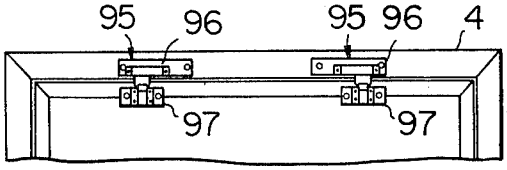
FIG. 23 is a front elevation view of lock means for the movable shelter floor.

Lock means 95 for the movable shelter floor 10, as shown in FIGS. 3, 4 and 23, comprises a locking body 96 secured to the framework 4 at the upper edge and a catch catching body 97 secured to the movable shelter floor at the free end.

Lock means 98 for the cover 14 is constructed similarly to lock means 95 for the movable shelter floor 10 and comprises a locking body 99 secured to the cover 14 at the free end and a catch body 100 secured to the floor 10 at the escape exit 12 facing the locking body 99.

Lock means 95 for one of the movable shelter floors 10 is operatively associated with those of the movable shelter floors on the other stories and when the movable shelter floor 10 on one of the stories is unlocked, the lock means 95 for the floors 10 at least on the adjacent stories above and below the one story are unlocked to permit the movable shelter floors 10 to be opened.

The lock means 95 for the movable shelter floor 10, the actuator 80, the brake 87, lock means 56 for the protecting fence 50, lock means 98 for the slide type extensible escape means 30 and the hoist 47, all of which constitute operating means to pivotally move the movable shelter floor 10 and the slide type extensible escape means 30, are manually actuable so they can be operated in the event of a power stoppage or accident and, in such case, the evacuees preferably unlock lock means 95 for the movable shelter floor 10 and operate the actuator 80 to pivotally move the shelter floor 10. Of course, at that time, lock means for the movable shelter floors 10 on the adjacent stories are unlocked while the shelter floors are braked by the mechanically operated brakes. After the movable shelter floors 10 are pivotally moved to the horizontal position, the lock means 59 for the protecting fences 50 are unlocked and the fences are assembled. Thereafter, the cover 14 on the emergency side is unlocked from the lock means 98 and then the slide type extensible escape means is downwardly extended to form the escaping passageway A between the adjacent stories. It will be appreciated that the operating means is so arranged that its components can be operatively associated with each other in an electrical manner rather than in a mechanical manner. In such case, the hoist 47 which is provided on the movable shelter floor 10 to pull the slide type extensible escape means up is driven by an electric motor having an electro-magnetic brake, and the lock means 56 which serves to lock the movable portions 55 of the posts 51 in the collapsed condition, are electro-magnetic type means. Furthermore, the brake 87 can have a hoist 88 driven by an electric motor 106 and also include electro-magnetic brake means. Also, lock means 95 and 98 for the movable shelter floor 10 and for the cover 14 can be of an electro-magnetic type.

Figure 24:
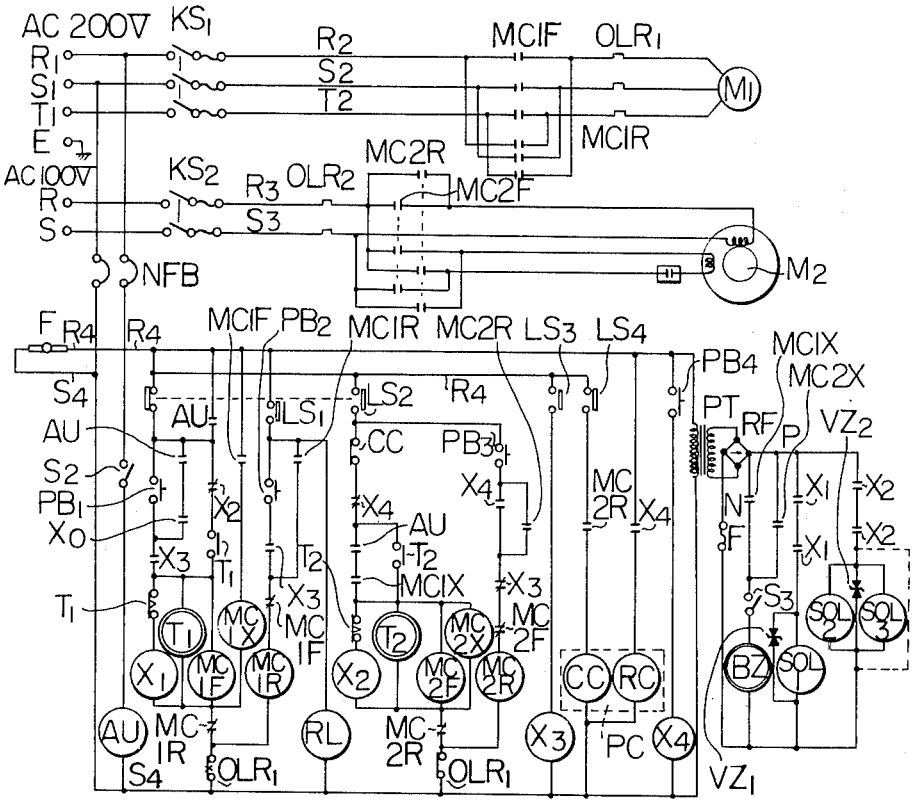
FIGS. 24 to 26 are circuit diagrams of a sequence circuit for the embodiment shown in FIGS. 1 to 18 and 23.
Figure 25:
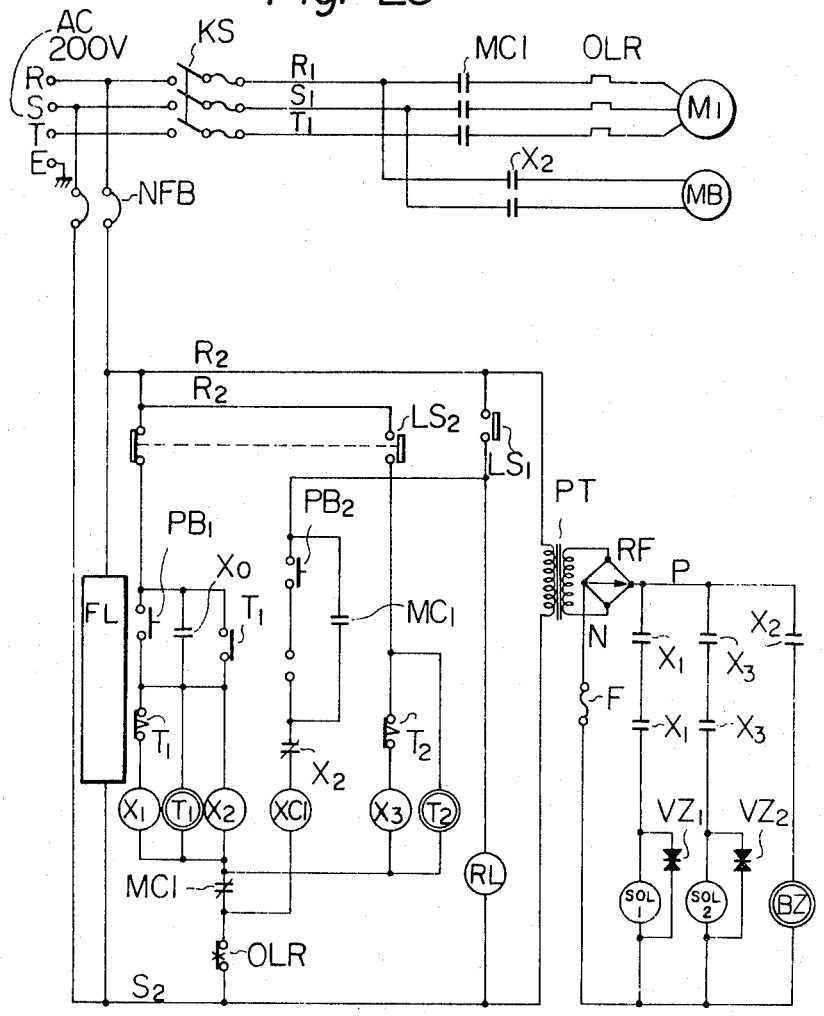
Figure 26:
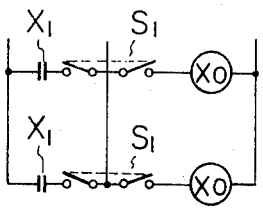

The containing case 91 contains the brake 87, the hoist 88, the lock means 95 and 98 for the movable shelter floor 10 and for the cover 14, the electro-magnetic lock means 56, and control boxes 107 and 108 in which there are contained the position detectors $LS_1$ and $LS_2$ for the movable shelter floor 10, the position detectors $LS_3$ and $LS_4$ for the slide type extensible escape means 30, knife switches $KS_1$ and $KS_2$ for the preset counter PC for detecting the horizontal position, electro-magnetic contactors MC1R, MC1F, MC2R and MC2F, a relay, a temporary relay, an auxiliary relay, a preset counter PC and the components associated therewith (see FIGS. 24 to 26).

Now, the emergency escape comprising the electrically operated means will be described, and more specifically with reference to FIGS. 24 to 26 in order to make more clear the operation of the movable shelter floor 10. Normally, the shelter floor 10 is arranged as shown in FIG. 3 and the electrical components therefor are operatively associated with each other as shown in FIGS. 24 to 26. It should be noted that power switches are closed for causing the operation of the system when an emergency occurs. For example, if a fire is found, the evacuees press the initiation push button switch $PB_1$ provided adjacent to the door 94 of the containing case 91, to operate a warning buzzer 109(BZ) and they enter the case 91 by opening the door 94.

As the push button switch $PB_1$ is closed, the coil $T_1$ of the timer relay for the lock means 95 and 98 for the movable shelter floors 10 on respective stories is energized to close the normally open contact $T_1$. At that time, the coil MC1F of the electro-magnetic contactor and the relay $X_1$ are also energized. Thus, the lock means 95 for the movable shelter floor 10 is unlocked by energization of the solenoid coil $SOL_1$ and therefore, the actuator 80 operates to allow each of the movable shelter floors on the stories to pivotally move to the horizontal position. During that time, the wire rope 90 on the drum 89 of the hoist 88 is unwound and the limit switch $LS_1$ for detecting the closed position of the movable shelter floor 10 is permitted to close its normally open contact. During pivotal downward movement of the shelter floor 10, its own gravity is added to the rotational force applied by the actuator 80 to increase the speed of pivotal movement.

If the speed of pivotal movement exceeds the predetermined value so that the motor 106($M_1$) rotates at over a synchronous speed, it acts as an induction generator to produce a regenerative braking, which causes the drum 89 to be braked so that the speed of pivotal movement is controlled to less than the predetermined value. When the normally open contact of the limit switch $LS_1$ is closed, the emergency induction lamp 23(RL) is lighted.

The shelter floor 10 continues to pivotally move until it reaches the horizontal position, and at that time the limit switch $LS_2$ for detecting the horizontal position of the shelter floor 10 is operated by a projection 20 on the support means 19 to close its normally open contact and to open its normally closed contact. Thus, the circuit for the shelter floor 10 is broken and therefore, the motor 106($M_1$) controlling stops the speed of the shelter floor. As the normally open contact of the limit switch $LS_2$ is closed, the timer relay coil $T_2$ for the lock means 98 for the cover 14 and the lock means 56 for the protecting fence 50 is energized to close its normally open contact $T_2$. Also, the coil MC2F of the electromagnetic contactor and the relay $X_2$ are energized. Thus, the solenoid coils $SOL_2$ and $SOL_3$ of the lock means 98 and 56 are energized to unlock them. Thus, the cover 14 is opened by its own weight and that of the slide type extensible escape means while the movable post portions 55 of the protecting fence 50 are raised by the return springs 57 and held at the vertical position by the latch means 68.

When the cover 14 is opened, the slide type extensible escape means 30 is downwardly extended. More specifically, the pair of support arms 32 and 33 are telescopically expanded at a predetermined inclined angle and the sliding member 36 is also extended along the support arms. As the support arms 32 and 33 expand, the wire rope 49 at one end secured to the leading tube 31*e* is unwound. Therefore, when the speed of extension of the support arms 32 and 33 exceeds a predetermined value, the electric motor 111($M_2$) of the hoist 47 acts as an induction generator to produce a regenerative braking so as to brake the extension of the support arms 32 and 33, in the same manner as described in connection with the pivotal movement of the shelter floor 10.

When the slide type extensible escape means 30 is fully extended, the limit switch $LS_3$ for detecting the stored position of the escape means is operated to close it normally open contact to operate the preset counter PC for detecting the extension of the escape means 30. This preset counter PC may comprise a reset portion RC and a counter portion CC, the latter of which counts signals from the limit switch $LS_4$ for measuring the extended length of the slide type escape means.

As the leading end of the escape means 30 reaches the catching base 43 of the next lower movable shelter floor 10, the counter portion CC opens its normally closed contact to interrupt the operation of the motor $M_2$ from its operation to thereby stop the hoist 47.

In this manner, the slide type extensible escape means 30 is downwardly extended until the leading end of the escape means reaches the catching base 43 of the next lower floor 10 where the latching rod 41 is locked to the catching member 44. Thus, the escaping passageway A is formed between the adjacent stories. The evacuees on the lower stories where the emergency occurs, grip the handrail 45 and mount a foot on the foot guard 46, after which they transfer their bodies to the sliding member 36 of the escape means 30. Thus, after releasing their grip on the handrail 45 and the foot guard 46, they can slide downwardly on the sliding member until they reach the next lower shelter floor 10.

The evacuees can enter the next lower story or slide down the escaping passageway A between that story and the next lower adjacent floor 10.

After the end of the emergency, the latching rod 41 on the escape means 30 is released from the catching member 44 and then the push button switch $PB_4$ is operated to energize the auxiliary relay $X_4$ for signalling the withdrawal of the slide type extensible escape means 30. Thereafter, the push button switch $PB_3$ is operated for returning the slide type extensible escape means 30 to the original condition. More specifically, as the push button switch $PB_3$ is operated, the electro-magnetic contactor MC2R is energized to drive the motor 111($M_2$) to thereby rotate the hoist 47 in the winding direction. Thus, the support arms 32 and 33 together with the sliding member 36 are contracted by telescopically withdrawing the leading tubes 31*a*, 31*b*, 31*c*, 31*d* and 31*e* into the rear outside tubes 31, 31*a*, 31*b*, 31*c*, and 31*d*, respectively, by means of the wire rope 49 of the hoist 47. Thus, as the support arms 32 and 33 are pulled up until the escape means 30 is received in the cover 14 of the shelter floor 10, the limit switch $LS_3$ is operated to open the contact to interrupt the current flowing through the motor 111($M_2$) to stop the hoist 47. Thereafter, the operator can lock the cover 14 together with the escape means 30 to the corresponding shelter floor 10 adjacent to the escape exit 12 by means of the lock means 98, as shown in FIG. 4. Subsequently, the protecting fence is disassembled and then the movable post portions 55 are locked to the stationary post portions 54 by means of the lock means 59.

Since the normally open contact of the limit switch $LS_1$ is closed, the normally closed contact of the limit switch $LS_2$ is opened while the normally open contact of the limit switch is closed, as the push button switch $PB_2$ is pressed for effecting upward movement of the movable shelter floor 10, the electro-magnetic contactors MC1R and MC1X are energized to drive the motor 106($M_1$) to rotate the hoist 88 in the winding up direction.

Thus, as the hoist 88 is driven, the wire rope 90 is taken up on the drum 89 of the hoist 88 and as a result the shelter floor 10 pivotally moves upward about the pivotal shaft B until it is received in the framework 4 of the opening 3. At that time, the limit switch $LS_1$ is caused to open its contact and therefore, the current flowing through the motor 106($M_1$) is interrupted to thereby stop the hoist 88. When the shelter floor 10 is received by the framework 4 in a sealing relation thereto, the electric system is returned to the original condition as shown in FIGS. 24 and 25. It will be appreciated that the preset counter PC is reset by the reset portion RC for subsequent operation of the emergency escape.

Figure 27:
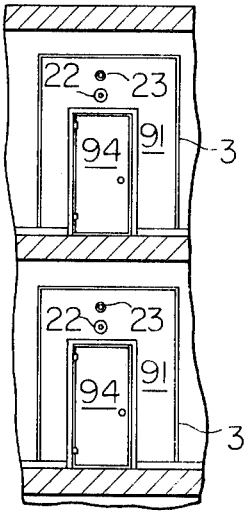
FIG. 27 is a view substantially similar to FIG. 2, but shows a preferred modification of the emergency escape.
Figure 31:
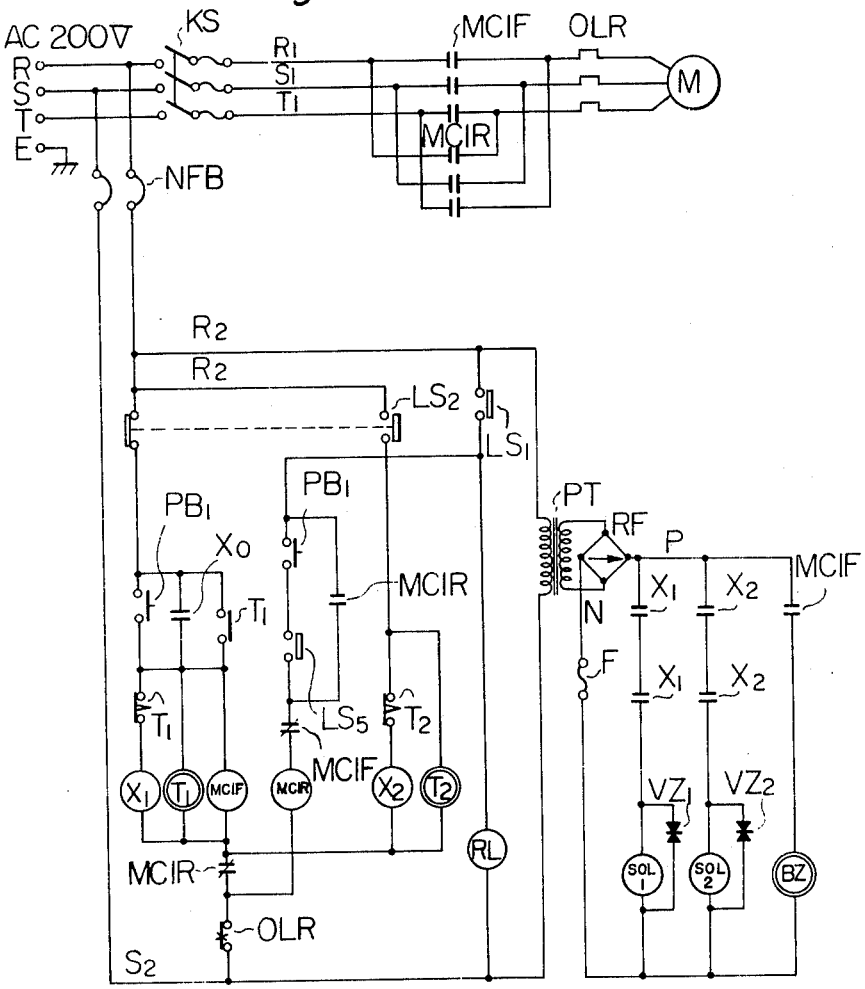
FIG. 31 is a circuit diagram of a sequence circuit for the embodiment shown in FIGS. 27 to 30.

FIGS. 27 and 31 show another modification of the present invention, wherein a ladder type extensible escape means 130 is provided adjacent to the escape exit of a movable shelter floor 110. The escape means is similarly communicated with the next lower shelter floor 10 to form the escaping passageway A when it is to be used. In this embodiment, the support means 15 for the shelter floor 110 as well as the lock means 98 for the cover 14 have been modified, because a ladder type extensible escape means 130 is used. The same numerals designate the same components as described in connection with the above described embodiments.

Figure 28:
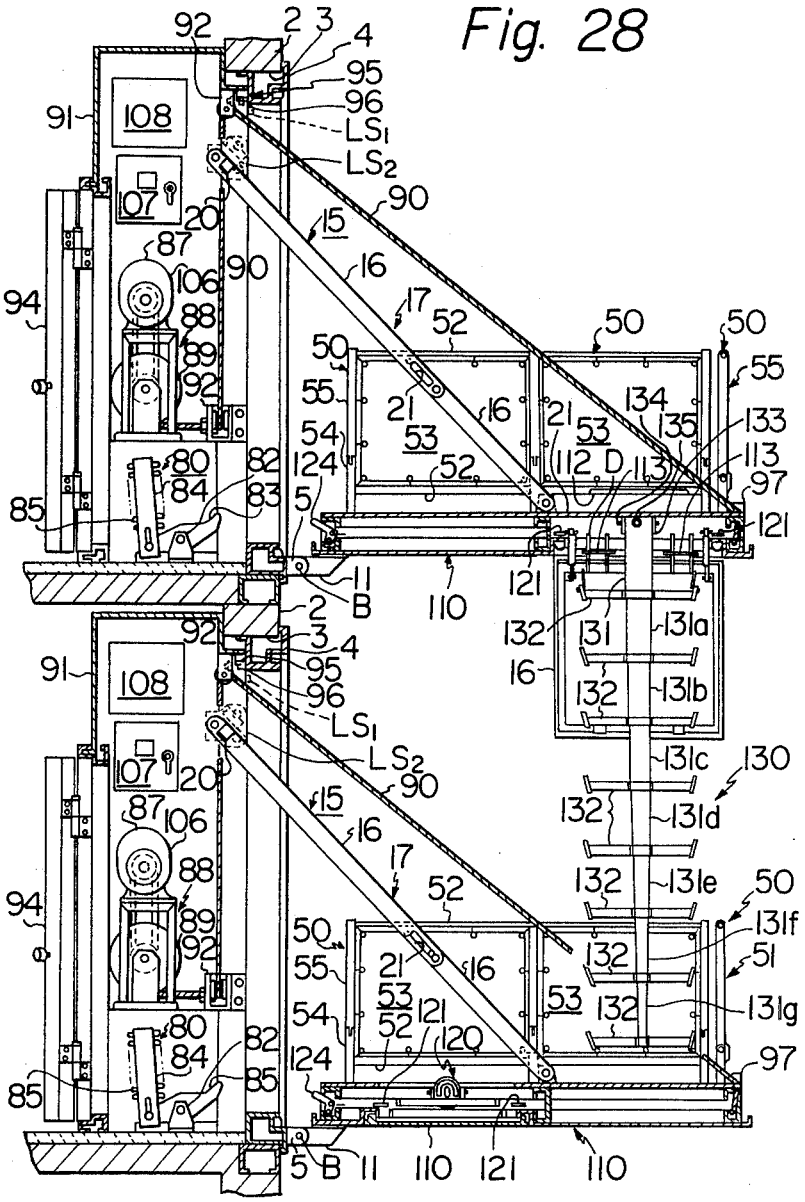
FIG. 28 is a sectional side elevation of the embodiment of FIG. 27 when it is in use.

The movable shelter floor 110 is pivotally mounted on the framework 4 with the movable pieces 11 on the floor 110 being pivoted to the stationary pieces 5 on the framework 4 about the pivotal shaft B so that the shelter floor 110 sealingly closes the opening 3. The movable shelter floor 110, as shown in FIG. 28, is suspended from the framework 4 by the support means 15 which comprises a pair of linkages 17 each including two link members 16 pivotally connected to each other, when it is positioned horizontally relative to the outer surface 2 of the building wall 1. The movable shelter floor 110 has an escape exit 12 formed at the free end and closed by the pivotal cover 14.

The cover 14 has the ladder type extensible escape means 130 mounted thereon so that it is received in the cover 14.

The ladder type extensible escape means 130 comprises an extensible post including eight telescopical tubes 131, 131*a*, 131*b*, 131*c*, 131*d*, 131*e*, 131*f* and 131*g*, and rungs 152 traversely attached to the telescopical tubes, respectively. The outermost tube 131 is pivotally mounted on a bracket 133 at the escape exit 12 so that the extensible post of the escape means is suspended from the shelter floor when it is to be used.

A hoist 135 is provided at the outermost tube 131 of the ladder type extensible escape means 130. This hoist 135 may comprises a drum (not shown) having a ratchet, and a wire rope (also not shown) having one end secured to the drum and the other end secured to the innermost tube 131*g* so that it is either taken up or unwound on the drum. Thus, the hoist 135 which is disengaged from the ratchet, permits the ladder type extensible escape means 130 to be downwardly expanded or to be contracted by rotation of the drum so that the inner tubes 131*a*, 131*b*, 131*c*, 131*d*, 131*e*, 131*f* and 131*g* are telescopically received into the outer tubes 131, 131*a*, 131*b*, 131*c*, 131*d*, 131*e* and 131*f*, respectively.

The ladder type extensible escape means pulled up by the hoist 135 is automatically locked by the ratchet and thereafter the cover 14 together with the escape means is upwardly moved to the horizontal position where the escape exit 12 is closed and the escape means is received in the shelter floor 110. A handrail 112 and a foot guard 113 to facilitate transference of the evacuees to the ladder type extensible escape means 130 are provided adjacent to the protecting fence 50 and the escape exit 12, respectively.

Figure 29:
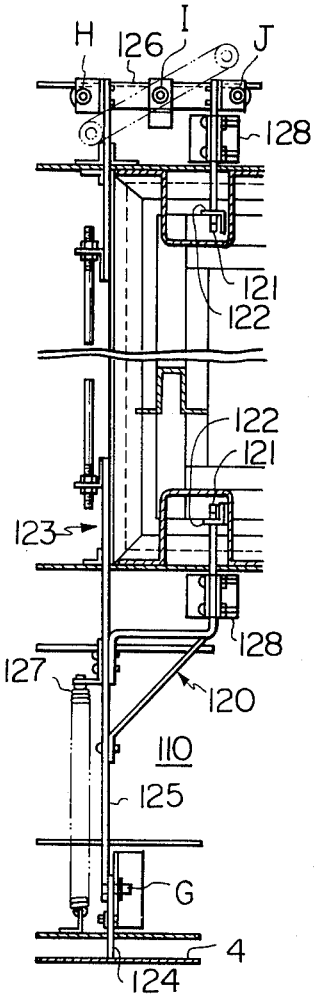
FIG. 29 is a top view of lock means for a cover on a movable shelter floor with a portion broken away.
Figure 30:
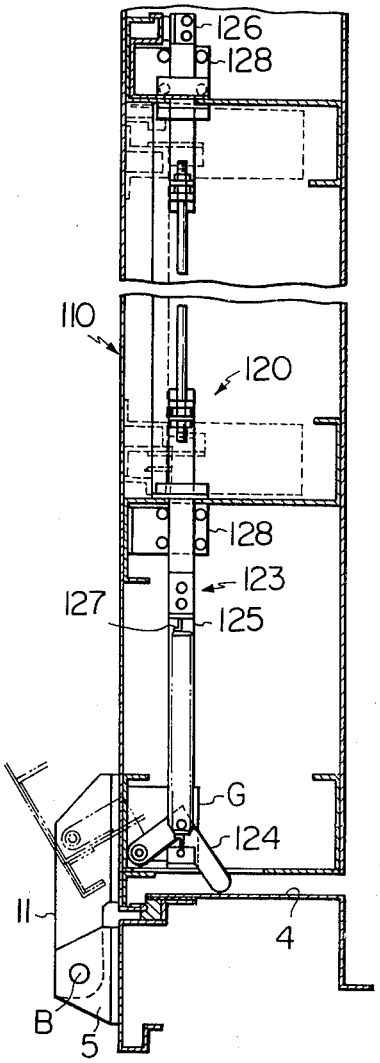
FIG. 30 is a front view of the lock means shown in FIG. 13.

Lock means 120 for the cover 14 are mechanically operable as shown in FIGS. 29 and 30. This lock means serves to lock the cover 14 in cooperation with the closure of the movable shelter floor 110 and to unlock the cover 14 in cooperation with opening of the movable shelter floor 110, and comprises a pair of latches 121 provided on the shelter floor 110, a pair of hooks 122 mounted on the cover 14 and a drive mechanism 123 to engage or disengage the latches 121 with the hooks 122.

The drive mechanism 123 includes an L-shaped operating member 124 having one end pivotally mounted on the shelter floor 110 as indicated at the point F in FIGS. 29 and 30 and the other end forced against the inner surface of the framework 4, a connecting rod 125 pivotally mounted on the angular portion of the operating member 124 as indicated at the point G, one of the latches 121 being secured to the connecting rod 125, a connecting arm 126 pivotally mounted on the connecting rod 125 at the top end to operate the other latch 121, and a biasing spring 127 to bias the connecting rod 125 toward the lower edge of the framework 4. The connecting rod 125 is preferably constructed so that its length is adjustable while the connecting arm 126 at the middle portion is pivotally mounted on the cover 14, the end of the connecting arm 126 remote from the point H being pivotally mounted on the other latch 121.

Of course, the connecting rod 125 and the connecting arm 126 have slots through which the pivotal shafts extend so as to permit movement of the rod and the arm. The latches 121 effect a movement by means of respective guide members 128.

The ladder type extensible escape means 130 is vertically suspended from the upper of the adjacent shelter floors 110 and extends to the lower one thereof so that no catching base is required as used in connection with the slide type extensible escape means 30 of the above described embodiments. However, in order to prevent displacement or swinging movement of the ladder, the uppermost tubes 131 of the support arms and the shelter floor 110 at the escape exit 12 are preferably connected by a wire rope (not shown).

As is apparent from FIG. 28, the adjacent movable shelter floors 110 are desirably so constructed that one of the shelter floors has the escape exit 12 positioned at the free end of the shelter floor while the other shelter floor has the corresponding escape exit 12 positioned at the pivoted end of the shelter floor.

Since the actuator and the brake for the shelter floor 110 are constructed in the same manner as described in connection with the above described embodiments, the description thereof will be omitted, the same components having the same numerals attached thereto.

Referring now to FIG. 31, the operation of the ladder type extensible escape means 130 will be described hereinafter.

The drive apparatus for the escape system of FIGS. 28 to 30 can be controlled by the electric circuit as shown in FIG. 31 and which is substantially identical to that of FIGS. 24 to 26. When a fire occurs, the evacuees press the initiating push button switch $PB_1$ on the case 91 at the door 94 to operate the warning buzzer 22(BZ) and enter the case 91.

As the push button switch $PB_1$ is pressed, the timer relay coil $T_1$ of the lock means 195 for the movable shelter floor 110 is energized to close its normally open contact. At energization of the coil $T_1$, the coil MC1F of the electro-magentic contactor and the relay $X_1$ are also energized. Thus, the solenoid coil $SOL_1$ of the lock means 95 for the movable shelter floor 110 is energized to unlock the lock means 95 to thereby operate the actuator 80 which causes the respective movable shelter floors 110 to pivotally move until they reach the horizontal position as shown in FIG. 28. During pivotal movement of the shelter floors, the wire rope 90 of the corresponding hoist 88 is unwound from the drum 89, so that a braking force is applied to the shelter floor to control the excess speed thereof. The emergency induction lamp 23(RL) is lighted by closure of the normally open contact of the limit switch $LS_1$ for detection of the storage position of the shelter floor 110.

In the same manner as described in connection with the above described embodiments, if the movable shelter floor 110 which is lowered by its own weight in addition to the rotary force from the actuator 80 has a speed exceeding the predetermined value corresponding to the synchronous speed of the motor 106($M_1$), then the motor acts as an induction generator to produce a regenerative braking force to brake the drum 89 so that the speed of the movable shelter floor 110 is controlled so that it is less than the predetermined value.

When the movable shelter floor 110 reaches the horizontal position, the limit switch $LS_2$ for detection of the horizontal position is operated by the projections 20 on the support arm 17 of the support means 15 to close its normally open contact and open its normally closed contact. Thus, the circuit to drive the shelter floor 110 is broken so that the motor 106($M_1$) stops controlling the movement of the shelter floor 110.

As the timer relay coil $T_2$ of the electro-magnetic lock means 56 and the relay $X_2$ are energized to operate the solenoid coil $SOL_2$ so that the movable post portions 55 of the protecting fence 50 move upwardly relative to the stationary post portions 55 by means of the return spring 57. The latch means 58 locks the movable portions in the raised condition. Thus, the fence 50 is erected. Furthermore, as the movable shelter floor 110 pivotally moves to the horizontal position, the L-shaped operating member 124 is far away from the framework 4 and therefore, by the action of the biasing spring 127 the connecting rod 125 moves axially until the latches 121 are removed from the hooks 122. Thus, the cover is pivotally opened by its own weight and the ladder type escape means 130 is vertically suspended.

After acknowledgement of the safety of the movable shelter floor 110, the hoist is disengaged from the ratchet so that the ladder type escape means 130 is downwardly extended by its own weight.

Thereafter, the evacuees can transfer from the shelter floor 110 to the ladder while gripping the handrail 112 and mounting their feet on the foot guard 131 and move to the shelter floor 110. Thus, they can be removed to a safe place or to a further lower shelter floor 110.

In case the escape is to be returned to the inoperative position, the operator drives the hoist 135 to pull up the ladder type escape means 130 by means of the wire rope. As the ladder is withdrawn into the cover, the ratchet acts to automatically lock the ladder type escape means to the cover 14. Thereafter, as the cover 14 is closed, the ladder type escape means 130 is positioned so that it is mounted on the cover as shown at the lower floor 110 in FIG. 28.

Subsequently, the protecting fence 50 is dismantled with the movable post portions being collapsed and being locked by the electro-magnetic lock means 56. At that time, the normally open contact of the limit switch $LS_5$ is closed to detect the collapsed condition of the movable post portions 55.

Since the normally open contacts of the limit switches $LS_1$ and $LS_5$ are closed, when the push button switch $PB_2$ is pressed to energize the electro-magnetic contactor MC1R, the motor 106(M) is driven to rotate the hoist 88 in the taking up direction of the wire rope. Thus, the movable shelter floor 110 moves upwardly about the shaft B until it is received in the framework 4.

At that time, the limit switch $LS_1$ has its contact open and therefore, the current flowing through the motor 106(M) is interrupted so that the hoist 88 stops operation.

Thus, when the shelter floor 110 is received in the framework 4, the limit switch $LS_1$ is returned to the original condition in which the lock means 120 locks the cover 14. Furthermore, the electrical system for drivng the shelter floor 110 is returned to the original condition ready for a subsequent operation.

FIG. 32 shows a modification of the ladder type extensible escape means in accordance with the present invention. In this embodiment, the ladder type extensible escape means 140 comprises a pair of support arms 143 and 144 in the form of lazy-tongs including a number of extensible units each having two strips 141*a* and 141*b* at the middle portions pivotally connected to each other, and being pivotally connected to each other, and treadles 145 secured between the support arms 143 and 144. The movable shelter floor 110 on which the escape means 140 is mounted, the lock means 95 and 98, the brake 87 and the actuator 80 for the shelter floor 110 are substantially identical to those of the escape shown in FIGS. 28 to 30 and therefore, the description thereof will be omitted.

FIGS. 33 to 38 show another modification of the present invention wherein stairway type extensible escape means 230 communicates the upper one of the adjacent movable shelter floors 210 with the lower one. The escape means 230 is normally contained in the shelter floor 210 at the escape exit 12 and when it is to be used, it is expanded to form an escape passageway A.

The movable shelter floor 210 is pivotally mounted on the framework 4 as described in connection with the above described embodiments, so that it sealingly closes the opening 3. The support means 15 which comprises a pair of linkages 17 including two link members 16 pivotally connected to each other, is suspended from the movable shelter floor 210 which is in the open or horizontal position. The pivotal cover 14 normally closes the escape exit 12 in the movable shelter floor 210.

The stairway type extensible escape means 230 is normally contracted and contained in the shelter floor 210 at the escape exit 12. This escape means 230 comprises a pair of support arms 232 and 233 including a number of telescopically engaged tubes 231, 231*a*, 231*b*, 231*c*, 231*d* and 231*e* with the inner tubes 231*a*, 231*b*, 231*c*, 231*d* and 231*e* being slidably engaged in the outer tubes 231, 231*a*, 231*b*, 231*c* and 231*d*, and twelve treads 234 slidably suspended from and between the support arms 232 and 233 to form an escape passageway A together with the support arms 232 and 233.

The stairway type escape means 230, when it is extended is so arranged that the uppermost or outermost tubes 231 extend through the corresponding escape exit 12 and are pivotally mounted on posts 212 which are in turn secured to the shelter floor 210 in a vertical position as shown in FIG. 34 and that the lowermost or innermost tubes 231*e* of the support arms 232 and 233 are each provided with an angular frame member 235 guided by the catching base 43 on the lower movable shelter floor 210, as shown in FIG. 35. A positioning device 213 is preferably provided on the outermost tubes 231 of the support arms 232 and 233 to facilitate the inclined extension of the escape means 230 relative to the lower movable shelter floor 210 at a predetermined angle.

As shown in FIGS. 36 to 38, the treads 234 between the support arms 232 and 233 each include a tread portion 237 having an edge portion 236 depending, a riser portion 239 pivotally mounted on the tread portion 237 at the rear end by a pivotal shaft 238, and a pair of suspending rods 240 having the upper ends pivotally and slidably suspended from the support arms 232 and 233.

When the escape means 230 is not in use and contained in the movable shelter floor 210 at the escape exit 12, the treads 234 are collapsed so that the tread portions 237 are pivoted up against the riser portions 238 as shown in FIG. 36. When the escape means 230 is to be used, the treads 234 are positioned so that the edge 236 of a tread portion 237 of an upper tread 234 engages the upper edge of a riser portion 239 of a lower tread 234, as shown in FIG. 37.

As shown in FIG. 37, the treads 234 are connected to the pair of support arms 232 and 233 by the suspending rods 240 supported at the upper ends supported on wheels 241 which in turn engage the interiors of the telescopical tubes 231*a*, 231*b*, 231*c*, . . . 231*e* of the support arms 232 and 233. The wheels 241 suspending the rods 240 preferably have a diameter corresponding to the inner diameter of the tubes 231 to 231*e* which carry the respective rods 240, so that the treads 234 are prevented from unsteady movement. Wire ropes 242 which are connected between the adjacent wheels 241 serve to hold the wheels at a uniform spacing when they are extended. As shown in FIG. 38, non-slip edge covers 243 preferably provided on the tread portions 237 and the edge portions 236 of the treads 234.

Lock means for the movable shelter floor 210 in the closed or open position thereof, an actuator for moving the movable shelter floor 210 to the horizontal position in response to the lock means, and a brake to control the speed of pivotal movement of the shelter floor 210 are substantially identical to those of the above described embodiments and therefore, they will not be described in detail.

Next, the operation of the escape of FIGS. 33 to 38 will be described.

The movable shelter floors on the respective stories are pivotally moved to the horizontal position as shown in FIG. 33. Then, the cover 14 on each of the shelter floors 210 at the escape exit is opened and thereafter, the stairway type extensible escape means 230 is downwardly extended to the lower shelter floor 210 or to the ground. The angle at which the support arms 232 and 233 inclined relative to the horizontal plane when extended is determined by the angle of the uppermost tubes 231 of the support arms 232 and 233 relative to the positioning device 213, which at the lower end engages the wall of the escape exit 12 when the support arms 232 and 233 are extended, as shown in FIG. 34.

On expansion of the support arms, the treads 234 are also folded down while the wheels 241 suspending the treads roll on the respective telescopical tubes, as shown in FIG. 37. Thus, the escaping passageway A is formed between the adjacent stories of the building.

While some preferred embodiments of the present invention have been described with reference to the accompanying drawings, it will be understood that they are by way of examples, and that various modifications and changes may be made without departing from the spirit and scope of the invention, which is intended to be defined only by the appended claims.

What is claimed is:

1. A movable shelter floor type emergency escape system for installation in a multi-story building, comprising a plurality of escape devices, each having:

a movable shelter floor pivotally mounted at one end at the lower end of an opening in the wall of each of the stories of the building and pivotable to a position to close said opening when said emergency escape system is not in use and pivotable to a horizontal position to open said opening when said emergency escape is used;

support means connected to said shelter floor for supporting said shelter floor in said horizontal position relative to the wall when said emergency escape is used;

said movable shelter floor having an escape exit therein to permit evacuees to pass therethrough;

a protecting fence on said movable shelter floor;

extensible escape means which in the non-extended condition is contained in said movable shelter floor at said escape exit when said emergency escape is not used and which is downwardly extended to the movable shelter floor on the next lower story when said emergency escape is used;

lock means for locking said movable shelter floor to the portion of the building defining the opening for holding the shelter floor in said opening when said emergency escape is not used;

a pressure accumulating spring type actuator coupled to said shelter floor for pivotally moving the movable shelter floor to the horizontally projecting position in response to the unlocking operation of the lock means; and a brake means coupled to said shelter floor for controlling the speed of pivotal movement of said movable shelter floor.

2. A movable shelter floor type emergency escape system as claimed in claim 1 in which said escape devices on adjacent stories are horizontally offset from each other and said extensible escape means is downwardly extended at an angle to the horizontal and parallel to the wall of the building.

3. A movable shelter floor type emergency escape system as claimed in claim 1 in which said escape exit in the movable shelter floor on one of two adjacent stories is near the end of the movable shelter floor adjacent the building and the escape exit in the movable shelter floor on the other of the two adjacent stories is near the outer end of the shelter floor when the shelter floor is in the horizontal position.

4. A movable shelter floor type emergency escape system according to claim 1, wherein said extensible escape means is a slide type escape means.

5. A movable shelter floor type emergency escape system according to claim 4, wherein said slide type extensible escape means comprises a pair of support arms each including a plurality of telescopically engaged tubes having different diameters;

a U-shaped frame member secured between said support arms at the leading ends of said support arms to form a lower exit; and a sliding member suspended from said support arms for forming a slide type escape passageway in cooperation with said support arms.

6. A movable shelter floor type emergency escape system according to claim 4, wherein said slide type extensible escape means comprises a pair of support arms each including a plurality of telescopically engaged tubes having different diameters;

a U-shaped frame member secured between said support arms at the leading ends of said support arms to form a lower exit;

a sliding member suspended from said support arms for forming a slide type escape passageway in cooperation with said support arms; and a catching base on said movable shelter floor for engagement by said U-shaped frame member on the support means from the escape device on the next higher story.

7. A movable shelter floor type emergency escape system according to claim 4, wherein said slide type extensible escape means comprises a pair of support arms in the form of lazy-tongs including a plurality of units each having two strips pivotally connected to each other at the middle portions thereof; and a sliding member suspended from said support arms for forming a slide type escape passageway in cooperation with said support arms.

8. A movable shelter floor type emergency escape system according to claim 1, wherein said extensible escape means is an expansible slide type escape means.

9. A movable shelter floor type emergency escape system according to claim 8, wherein said expansible slide type escape means comprises a slide body including inflatable means formed of refractory fabric covered with a sealing layer;

a gas cylinder filled with compressed inert gas; and a gas supplying device coupled between said gas cylinder with said inflatable means.

10. A movable shelter floor type emergency escape system according to claim 1, wherein said extensible escape means is an extensible ladder type escape means.

11. A movable shelter floor type emergency escape system according to claim 9, wherein said ladder type extensible escape means comprises an extensible post having a plurality of telescopically engaged tubes of different diameters, the uppermost tube being pivotally mounted on said movable shelter floor at said escape exit, and rungs traversely attached to said respective tubes.

12. A movable shelter floor type emergency escape system according to claim 9, wherein said ladder type extensible escape means comprises a pair of support arms in the form of lazy-tongs including a plurality of units each having two strips pivotally connected to each other, and treads provided between said support artms.

13. A movable shelter floor type emergency escape system according to claim 1, wherein said extensible escape means is an extensible stairway type escape means.

14. A movable shelter floor type emergency escape system according to claim 13, wherein said stairway type extensible escape means comprises a pair of support arms each having a plurality of telescopically engaged hollow bodies, and treads provided between said support arms and each including a riser portion, a tread portion and a pair of suspending rods suspending said tread from said support arms.

* * * * *